United States Patent [19]

Rumbaugh

[11] 3,986,891

[45] Oct. 19, 1976

[54] SELF CLEANING DISHWASHER AND OVEN COMBINATION

[76] Inventor: Hugh M. Rumbaugh, 1370 Revere Road, Akron, Ohio 44313

[22] Filed: May 20, 1971

[21] Appl. No.: 145,469

Related U.S. Application Data

[60] Continuation of Ser. No. 763,443, June 11, 1968, abandoned, which is a division of Ser. No. 504,775, Oct. 24, 1965, abandoned.

[52] U.S. Cl. ..... 134/58 D; 134/108; 134/115 R; 99/340; 99/357; 126/20; 219/400

[51] Int. Cl.[2] ..... B08B 3/02; B08B 9/00; A47J 27/10

[58] Field of Search ..... 134/22 R, 25, 58 D, 134/108, 115 R; 99/234 T, 340, 357, 359, 370; 126/20, 20.1, 369; 219/399, 400, 401, 412

[56] References Cited

UNITED STATES PATENTS

| | | | |
|---|---|---|---|
| 1,721,840 | 7/1929 | Smith | 219/400 UX |
| 1,755,918 | 4/1930 | Fagley | 99/359 X |
| 1,958,590 | 5/1934 | Peirce | 126/369 X |
| 2,408,331 | 9/1946 | Mills | 219/400 |
| 2,698,626 | 1/1955 | Rumbaugh | 134/93 |
| 2,969,450 | 1/1961 | Bernstein | 219/260 X |
| 3,066,213 | 11/1962 | Webber | 126/20 X |
| 3,142,748 | 7/1964 | Warren | 219/400 X |
| 3,177,342 | 4/1965 | Wickenberg | 219/399 X |
| 3,329,529 | 7/1967 | Lamar | 134/22 R |
| 3,364,338 | 1/1968 | Holtkamp | 219/412 X |
| 3,373,754 | 3/1968 | Squire | 134/58 D |
| 3,410,116 | 1/1968 | Levinson | 134/115 R X |
| 3,498,304 | 3/1970 | Rumbaugh | 134/93 X |
| 3,549,294 | 12/1970 | Kerr et al. | 134/58 D |

FOREIGN PATENTS OR APPLICATIONS

| | | | |
|---|---|---|---|
| 272,241 | 3/1951 | Switzerland | 126/369 |

*Primary Examiner*—Robert L. Bleutge

[57] ABSTRACT

An oven apparatus or dishwasher apparatus having a combination chamber wherein a heated liquid is impelled and recirculated in a chamber comprising of an oven chamber or a dishwasher chamber to carry out food cooking or surface cleaning operations within the combination chamber of the apparatus, also operations to prevent redeposition of food particles. A timer is also provided and adapted to operate the apparatus for cooking or cleaning cycles, which also allows selection of a pre-wash, or a main wash having a settling down abeyance period before a reuse of prior impelled liquid, or selection of a portion of the operation cycle for liquid cooking or steam cooking operations or dry heat operations.

6 Claims, 12 Drawing Figures

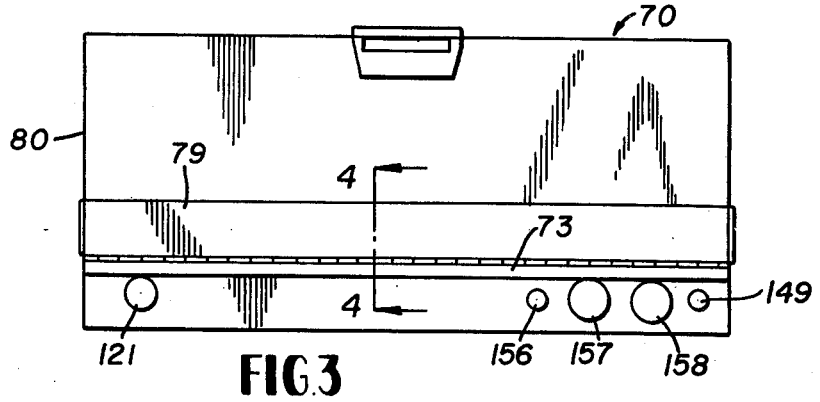
FIG.3
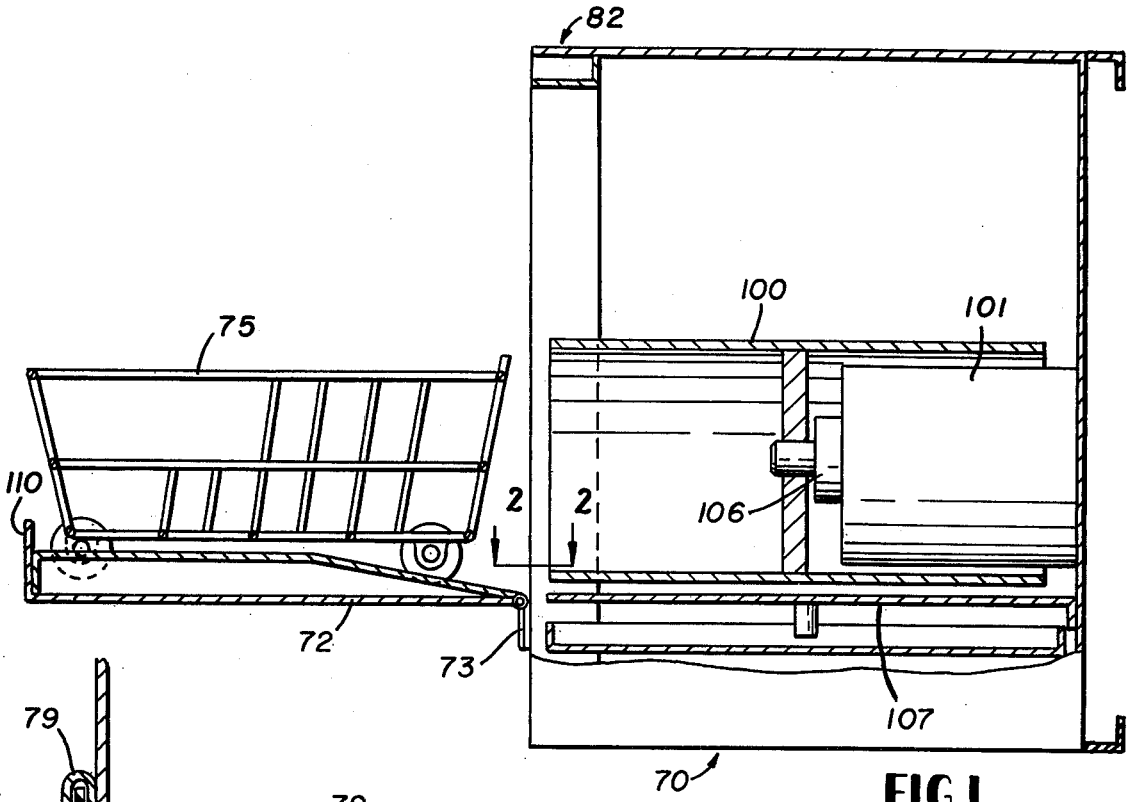
FIG.1
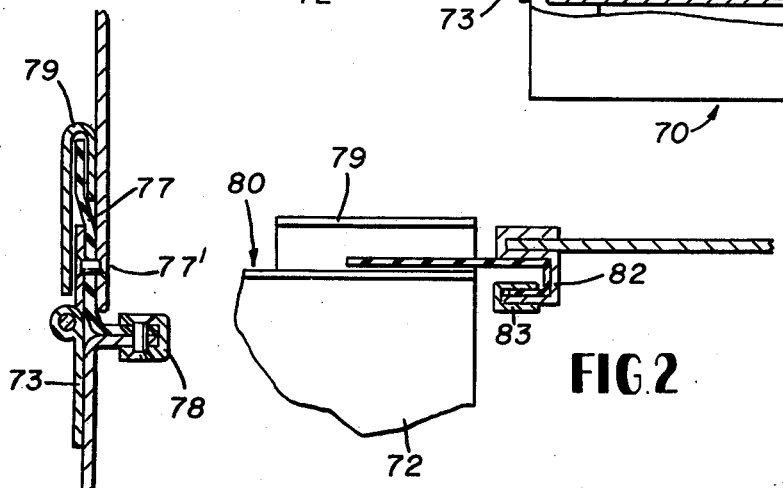
FIG.2
FIG.4

SELF CLEANING DISHWASHER AND OVEN COMBINATION

This is a continuation of application Ser. No. 763,443, filed June 11, 1968, now abandoned, which is a divisional application of Ser. No. 504,775, filed Oct. 24, 1965, now abandoned.

BACKGROUND OF THE INVENTION

For a dishwasher or a cooking apparatus to be efficient, redeposition of food soil must be avoided during the period of the cycle when a cleaning or cooking solution is impelled. Also said impelled solution must be impelled forcefully to all surfaces within such chamber.

A perforated mesh screen which is commonly used, will allow food particles the size of the mesh screen to be passed through said screen while a solution is being impelled during a dishwashing cycle, and redeposition will not be avoided. The new system disclosed herein of using an imperforated baffle in this invention avoids redeposition. Also, the system disclosed in this invention of adapting a smooth reversible roller, alternatively impelling a cleaning solution first in one direction and then in the opposite direction, impels the said solution forcefully first on one side, and secondly on the opposite side, onto surfaces to be cleaned, especially upon the sump area under the impelling means, which is unique, due to the ability of the smooth impeller to cause fluid to be directed and concentrated in the sump area, first in its upwards revolving direction as compared to the amount flowing on its opposite side in the sump area.

The improvement also disclosed in this invention provides a timer control system which de-energizes the solution impelling means after the surfaces within the said chamber receives a first forceful wetting spray.

During the de-energization period the cleaning solution is allowed to be reconditioned by permitting air, foam, suds and heavy matter to settle downwards in the said solution, and also allows said solution to settle downwards on surfaces towards the sump area, along with heavy matter. Upon re-using and re-energizing the impelling means to impel said reconditioned solution a forceful spray is again re-impelled to all surfaces within the chamber. Which operations, permits improved cleaning of surfaces within said chamber. This happens because, when the liquid impeller is re-energized a forceful, cascading, and maximum amount of liquid, having its greatest pressure is slung by the said impeller which forcefully pressures the food soil from surfaces within the chamber. Also because at this time when the maximum amount of heated liquid is being impelled the maximum of heat from said liquid is being transferred to the food to cook said food in an improved manner.

This invention relates to improvements in a self cleaning oven chamber or dishwasher chamber combination or cabinet apparatus which employs controlled reversible, heated liquid impelling means connected to said chamber wherein said chamber a heated liquid is impelled and is recirculated and directed to contact surfaces within the said chamber of the apparatus, and a controlled temperature in the range of 212° F or below is substantially maintained in said chamber to carry out simultaneously processes when desired of reconstituting frozen foods, cooking foods, and cleaning surfaces within said chamber. Also, said apparatus can be operated when desired to carry out other cooking or cleaning operations such as dry heat cooking in other temperature ranges as explained in more detail herein.

A chamber cleaning objective of this invention is to provide controlled reversible liquid impelling means in the chamber capable of establishing conditions in said chamber whereby liquid impelled by said controlled means impels liquid to all surfaces within said chamber, especially upon the chamber sump area wherein the accumulation of prior residue from dry heat cooking operations is built up in greater quantity than elsewhere in said chamber.

An object is to provide means of a fluid impeller consisting of a reversible motor driven substantially smooth roller rotatable mounted within said chamber adjacent its bottom and extending a substantial distance across the chamber having a drain in the bottom wall of the chamber, under the axis of the impeller with the bottom of the chamber adapted to drain thereto, having an imperforated baffle under the impeller with the opposite edges turned up to a level above the bottom of the impeller having a first space between the impeller and the baffle and a second space between the baffle and the bottom of the chamber, the chamber being adapted to be filled with a fluid to a level just above the bottom of the impeller, and having means within said chamber to supply heat to the chamber and the fluid therein, whereby upon rotation of the impeller means in one direction the fluid is impelled up and out of the first space in the upwards revolving direction of the impeller and impelled downwards as the impeller returns toward the first space, thereby and upon reversal of the direction of rotation impelling fluid throughout the chamber to dislodge soil particles from all surfaces within the chamber, said soil particles being concentrated in said second space at the side of the bottom wall drain in said one direction due to the greater amount of fluid flowing towards the said bottom wall drain from said one direction as compared to the amount flowing towards said bottom wall drain from the opposite direction.

During controlled liquid impelled cooking and surfaces cleaning operations in said chamber, it is obvious that cooking soil is not accumulated or burnt on surfaces of the chamber similarly to dry heat cooking operations in the chamber. The chamber is maintained clean during said controlled liquid impelled cooking operations.

An object is to provide an abeyance period after the initial operation of the cooking or cleaning liquid impelled cycle of said cycle to cause a settling out of air, foam, suds and fluid from the impeller, sump and pump means, which in other words, allows the liquid and heavy matter to settle downward in all areas or surfaces of the chamber before starting or reversing direction of the liquid impelling means.

Another object is to provide means to selectively move the cycle timer means when desired to a portion of the operating cycle wherein only means to reset a desired temperature is provided, also means to supply heat to the said chamber is provided, said means being controlled by the means that controls the timing period of said timer.

Another object is to provide an article supporting rack for cleaning articles and articles to be cooked.

Another object is providing a self cleaning chamber wherein the steps involved may be automatically carried out from the stand-point of the user every time the apparatus is started through a cleaning or cooking cycle.

A most desireable object of the cleaning apparatus is providing means to prevent redeposition of food soil within the cleaning chamber.

This is accomplished by providing an efficient system of separating solids from cleaning fluid which traps this residue in an area at the bottom sump area and disposing of said soil and fluid down a drain.

This apparatus comprises a cabinet or oven which includes a combined oven and washing chamber which is preferably open at the front.

The front opening is closed by a bottom hinged door which is pivotally mounted at the front of the cabinet for vertical movement between a closed position and a horizontal open position for access to the interior of the cabinet.

Across the front top and sides of the cabinet is a channel into which the extending lip of the door fits when closed.

Across the bottom of the cabinet and secured to the front angle of the bottom of the front is a novel seal arrangement.

The sides of the seal are cupped into, around and secured to the side channels of the cabinet. Said seal extends upwards aove the spill-over point of the metal portion of the front opening of the cabinet.

The lower outside portion of the door is positioned in front of the seal so that said seal extends part way up the outside of the door.

The hinge of the lower part is secured to the bottom of the cabinet leaving its upper part to the outside of the door bottom and providing an upwardly extending seal section which forms a barrier and rises the spill-over point higher than any liquid height permitted in the washing chamber.

The sides of the seal are also of the same height and are enveloped around the outside of the sides of the cabinet when the door is closed and are held against the sides by an angle which is secured to the strip that covers the seal extending up over the outside bottom of the door.

The upper part of the hinge is secured to the door bottom with the seal between it and the outer trim strip.

The seal is held in place but not under overall pressure. This allows air pressure from the cabinet to escape through the overlap area and acts as a relief from build-up of pressure in the chamber's interior.

When the impeller starts there is an expension of heated air and water vapor. Said seal relives this pressure.

The cabinet includes a bottom which forms a sump area and in the lower part of the sump is a drain outlet which is connected to a circulating pump and a drain pump. The circulating pump is connected through tubing to upper top spray units in the chamber which are preferably liquid-reacting, jet-type, revolving sprays and are controlled by a recirculating pump and timer means.

The waste discharge is installed in the same way, but the liquid pump means conveys the waste to a drain. A liquid line, having an automatically controlled inlet fill, is interposed in the supply line. It is connected to an interior communicating air-pressure gap located on the rear wall of the chamber.

As shown in FIG. 1, supported by a member on the rear wall and spaced above a baffle facility, is a smooth roll impeller or liquid slinger which extends adjacent to the front and rear walls and rotates about an axes. The impeller is operated by an electric motor and is mounted on the motor shaft for rotation. The impeller is made of stainless steel and is cylindrical with open ends. A hub supports the impeller and said hub is connected to the motor shaft and is secured by setscrews through an insert. A motor housing facility which encloses the motor is secured to the rear wall by an annular flange by means of nuts and bolts. The motor is of a reversing type.

The baffle facility under the impeller is for trapping solids. The novel features of the solid separation provides care-free operation, and its arrangement forces solid matter between the oven bottom and the baffle into a zone having a whirlpool effect where the matter is trapped and easily pulled out of the sump area by the pump for discharge from the apparatus.

An electric sheath-type heating element of round design can be advantageously located beside the impeller and disposed below the inlet side of the air gap.

Said heating element is connected to the cabinet rear wall by water-proof securing means and is also connected to a thermostat device and timer control system.

A novel feature of this arrangement is the fact that the incoming liquid falls on the heating unit. Said heating unit is concentrated in a small area and the liquid is instantly given a boost in heat, and penetrating steam is given off. Also, when the smooth impeller revolves, water is thrown by the impeller onto the said heater repeating the boosting of the temperature of the liquid. Said round heating unit performs another useful operation and serves all the functional use of a top-heating unit of a stove.

All splattering of grease such as that given off by any type of frying is spattered onto the cleanable interior surface of the chamber from which such grease is automatically removed when the apparatus is put through the cleaning cycle. Said heating element is also used for baking, heating and cooking foods. An example of the new novel method provided herein is the placing of frozen foods, preferably in their original package, on a combination rack supported within the cabinet, and the apparatus is put through a time-controlled cycle, as herein explained.

Means shown includes means for broiling, and a rotisserie which can be removed and replaced, as needed. It is to be understood that these facilities can be permanently installed in an apparatus less portable.

Drippings from foods being cooked fall to the bottom of the chamber and may be washed out during a cleaning cycle which follows the cooking cycle.

The sump may be filled with water and food drippings allowed to fall into the water, and then this residue may be disposed of through the pump disposal means.

The smooth impeller can circulate air over the foods being cooked to prevent moisture build-up around the foods, which is similar to the advantages of charcoal broiling wherein a large volume of air passes over the foods being broiled. Also, because of the arrangement and methods, an even heat is maintained, resulting in better cooking.

When defrosting frozen foods, the smooth impeller, revolving gently, moves a volume of air over the food, preferably while still packaged, and a closer tolerance of heat is maintained with the help of the thermostat system than has ever before been possible.

Also, the circulating air, forced by the smooth impeller, passes over the heating element picking up heat, and circulates it around the interior of the cabinet. An even temperature is maintained on all surfaces of the chamber, eliminating hot spots and minimizing the need for insulation. In most cases no insulation is needed, thereby making possible greater portability than is possible with units requiring insulation.

The combination of its use as a cleaning device and oven makes available a new kitchen appliance applicable in the cooking of the new processed foods, such as the frozen type. Fast thawing of these foods is desirable and is achieved in this apparatus.

Convenience of cooking food is controlled through the timing system.

The dual use of the control system is novel as well as methods. Grease after each cooking operation quickly gives off odors and in this device, grease does not have a chance to build up as its removal is effected each time the cleaning operation is effected, preferably soon after each use, and the tableware may be cleaned at the same time as the interior of the oven.

Preferred design of the equipment are shown in the drawings in which—

FIG. 1 is a side elevation of the enclosure with the door open to the horizontal position with a central portion broken away, and a rack resting on the door;

FIG. 2 is a plan view showing the corner construction of the enclosure and the rubber seal; on the line 2—2 of FIG. 1;

FIG. 3 is a front view of the enclosure of FIG. 1;

FIG. 4 is a section on the line 4—4 of FIG. 3;

Figure 5:
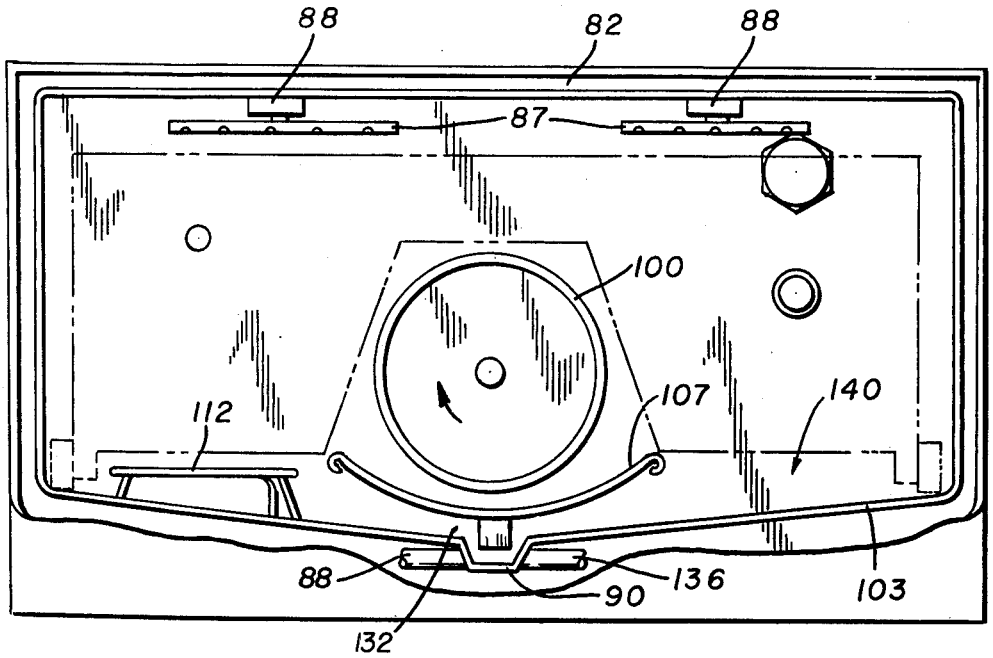
FIG. 5 is a front elevation of the enclosure shown in FIG. 1.

Detergent is added as desired. It may be sprinkled on to the bottom of the oven after removing the foodstuff. It may be added through separate supply means such as the detergent cup located on the inside of the door.

It may be operative when the door of the oven is closed so that the oven may be first flushed out with water before any detergent is added.

Cooking is simplified in this oven, in various respects.

For instance, in broiling a steak, it may be placed on an openwork rack, no drip pan is necessary.

The drippings fall to the oven bottom and are subsequently removed by the described cleaning procedure, preferably before the oven has cooled to the ambient temperature.

Also, grease splattered from a pan placed on a rack at any level within the oven is readily cleaned by this method, as well as matter accidentally spilled within the oven.

If desired, the bottom of the oven may be covered with water before broiling or using the rotisserie, to collect drippings from the meat so that they do not fall on to the bottom of the oven.

A frozen food is readily cooked in this oven while packaged in its original, water-tight container (such as oil, waxed paper, plastic film, etc., even though covered with paper, although the paper may first be removed).

This is done by placing the package on the rack 75 while the food is still frozen. Hot water, preferably near the boiling point is then sprayed on to the container from the spray.

Hot air or steam may be used, but in a home it is usually necessary to employ hot water. The food is thawed then cooked without losing any of its components such as are extracted when the food is cooked in water. The time required will depend upon the nature of the food and the temperature of the water.

The heating cycle may be regulated by a timer or manually.

FIGS. 1 to 12 show preferred type of oven 70 which may measure approximately 16 inches in height and, if desired, will fit on a kitchen counter under overhanging storage cabinets, and is preferably adjacent a sink.

The door 72 is hinged by hinges 73 at the bottom. Stop means is usually provided to hold the door horizontal, when opened, so that it will support rack 75 to hold tableware for cleaning, when desired.

This rack is rolled into the oven beside the impeller (described below) prior to starting a cleaning cycle. The cleaning cycle may be started even though the interior of the oven is not soiled, in which case the oven is utilized merely as a dishwasher. However, when the cleaning cycle follows use of the oven, the tableware can be cleaned simultaneously with the oven with no added water, and little additional heat and detergent.

There is a flexible resilient sheet 77 of neoprene or the like which is wider than the door and which is attached to the door and oven in such a way as to form a seal or barrier which prevents leakage of liquid from the interior of the oven when the door is closed. One edge of this sheet, which is fastened to the door, is higher than the normal spill-over point of the door when the door is closed, thus increasing the amount of cleaning liquid that can be held in the oven without changing the height of the spill-over and without increasing the height of the oven. In order to do this, the side edges of this sheet are folded over one another and held against the exterior of the edge of the oven opening which advantageously is the side wall of the oven.

The wall of the oven at the bottom of the door opening is flanged in, and this flange and the bottom edge of the sheet 77 are held together by the seal cap 78 which is fastened to this flange. The seal cap is no longer than the door. The side edges of the sheet 77 protrude beyond the ends of the seal cap and are bent up and folded around inside of the portion of the S-member 82 which extends upward from the level of the bottom of the door. These edges of the sheet are clamped in place by the caps 83. The front edge of the sheet 77 overlaps the outside of the bottom of the door and is secured to the door by the rivets 77'' which hold the hinge 73 in position.

This permits release of any pressure that may build up within the oven.

The cover plate 79 covers the portion of the sheet which is adjacent the front of the door, and the edges of the cover plate 79 are bent backward over the edges 80 of the door and spaced a short distance therefrom.

The back-turned edges of the cover plate 79 embrace the edges of the outside oven walls, covering the S-member 82. The edges of the sheet which protrude beyond the edges of the door are folded into these spaces provided between the edges of the door and the bent-over edges of the cover plate.

They preferably are not attached to anything. As the door is closed, the edges of the sheet fold over and collect against the front of the portion of the S-member 82 which is embraced by the cover plate 79. Thus the front of the sheet is folded and the edges of the sheet are held up so as to form a barrier against the escape of any liquid from the oven.

Figure 6:
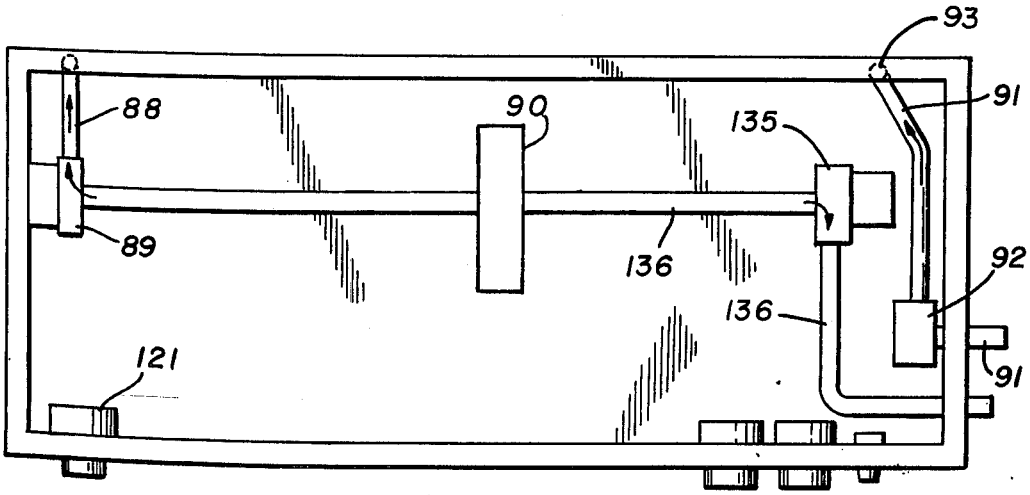
FIG. 6 is a bottom view of the enclosure shown in FIG. 5.

Within the oven are two top sprays 87 fed by conduit 88, and as shown in FIG. 6, by recirculating pump 89 which takes water from sump 90.

Figure 7:
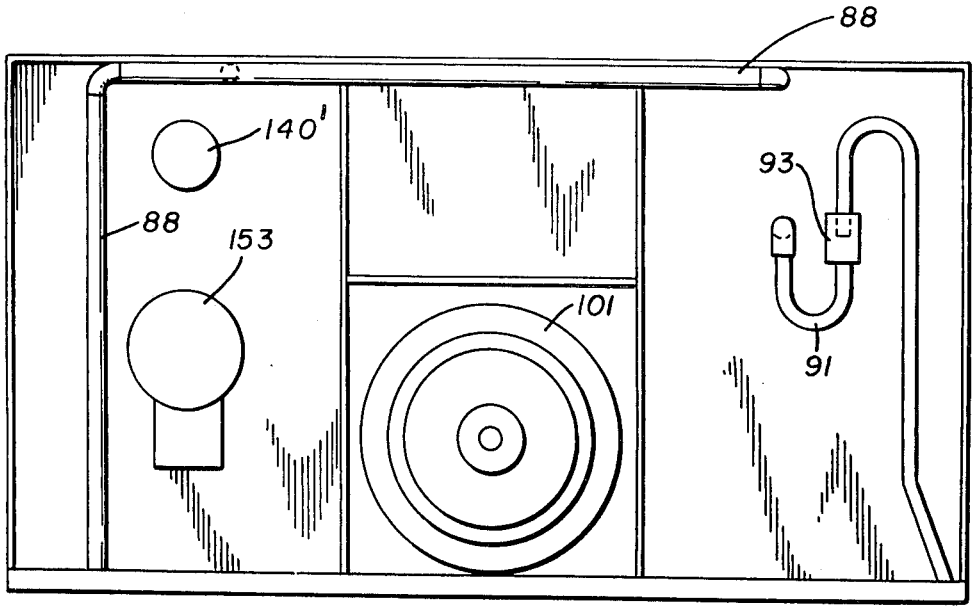
FIG. 7 is a back view of the enclosure shown in FIG. 3.

Fresh water is supplied by line 91 through time controlled inlet valve 92 to air gap 93, FIG. 7.

The use of these water sprays will be described below.

Impeller 100 is located in the oven, at about its midpoint. The diameter is such that spray from it will spray the oven when operated at a reasonable speed. In an oven 16 inches high a smooth-surfaced impeller 2 to 8 inches and preferably about 6 inches in diameter is satisfactory.

This impeller extends a substantial distance and preferably the major part of the distance between the front and back of the oven, although it may be located to extend from side to side. It may be made in two or more coaxial portions, and in this case each portion may be no thicker than a fan blade.

Two or more impellers may be located in a large oven. It is driven by a motor within the housing 101 located at the rear of the oven. The bottom 103 of the inside of the oven drains to sump 90 which drains into conduit 88 for recirculation. The motor shaft flanges 106 drives impeller 100. (FIG. 1.)

Below the impeller is the separation baffle 107 which is supported from the front and back of the oven.

The baffle separates the water in the space adjacent the impeller from the water on the bottom of the oven under the baffle.

The cleaning system may be used for cleaning the oven and/or cleaning tableware or other articles placed in the rack 75.

The door is closed, and the upper flange 110 fits into the S-shaped flange 82. The water is heated by element 112 or other suitable means. The inlet valve 92 has a timer controlled timed flow and introduces just enough water to partly submerge the baffle 107 and cover the bottom of the impeller 100. The water is recirculated through top sprays 87 by jet reaction by recirculating water from pump 89. The sprays and impeller spray the oven interior with cleaning water.

The heating element 112, FIG. 5, is of relatively small area compared with the area of the oven. Preferably it has a flat horizontal top so that it can be used as a flat plate for cooking (e.g. frying) foods at the same time that the oven is being used for other purposes, or entirely separately from any other use of the oven.

The heating element 112 also serves to decompose odorous vapor and/or smoke particles as air circulated by the impeller passes over and around the element 112 and is heated thereby.

Detergent is added as desired to both the pre-wash and the main wash.

Figure 11:
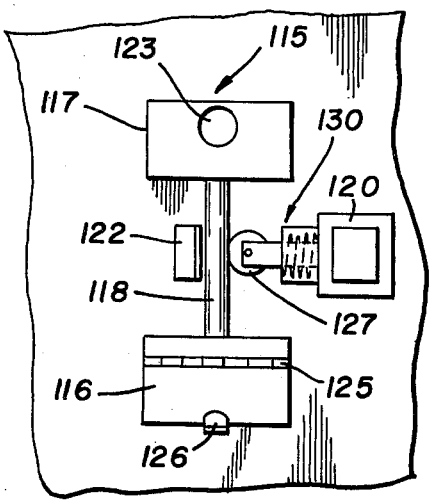
FIG. 11 is a rear view of the door showing the detergent means on the lines 11—11 of FIG. 10.
Figure 10:
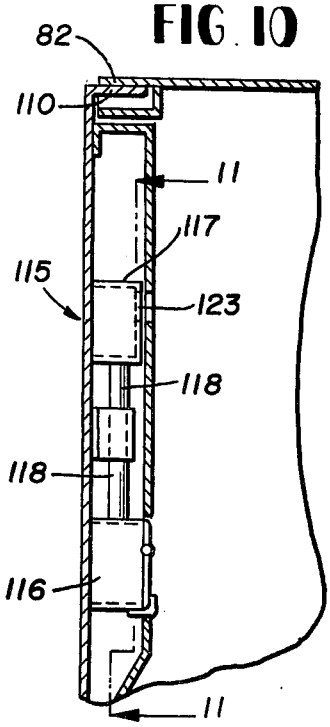
FIG. 10 is a section showing detergent means fastened to the door.

One preferred system of detergent supply means 115 is shown in detail in FIGS. 10 and 11. Detergent is added to the reservoir 116.

This reservoir is connected with water reservoir 117 by rubber tubing 118.

The solenoid 120 operated through time means 121 and spring 130 initially squeezes the tubing against plate 122 closing off reservoir 117.

Water sprayed within the oven collects in reservoir 117, through opening 123. The pre-wash detergent is placed within the oven, and conveniently placed in the sump 90 or on the open door. The main wash detergent is placed in reservoir 116 through the door which is supported by hinge 125, when the door is open, and the reservoir is then closed by latch 126. When the main wash starts timer 121 energizes solenoid 120 drawing back roller 127 to allow water in reservoir 117 to flow through tube 118 into reservoir 116 forcing the latch 126 open and the detergent is transferred out into the oven. A later impulse of time de-energizes solenoid 120 and spring 130 pushes roller 127 against tube 118 against plate 122.

The cleaning equipment shown includes no screens for separation of solid particles.

Screens are objectionable because they clog up. The means shown includes imperforated baffle structure below the impeller. The space between the baffle and the bottom of the oven provides as area 132 at one side or the other in the sump 90 wherein a whirlpool effect is created depending upon the direction of rotation of the impeller.

If the impeller is rotated in a clock-wise direction (see arrow in FIG. 5) the whirlpool is located at the side of the sump area indicated by reference numeral 132 because although the impeller throws water in both directions, the major portion is thrown off on the side of the oven on which the impeller lifts out of the water. Water thusly impinges on the sump area in which the impeller 100 is revolving in a downward direction towards the sump.

Water races down both sides of the bottom of the oven which forms a raceway under baffle 107. Both streams meet head-on in area 132 where the whirlpool is created and the solid matter is collected.

The timer actuates waste-disposal pump 135 (FIG. 6), when desired, and this pumps water and solid matter from the sump through conduit 136 to a suitable drain. Thus the solid particles trapped are prevented from being recycled through the oven spray. The sump may collect a substantial head of water. This water may stand several minutes in the sump to soften any waste deposit before a subsequent desired operation.

Figure 12:
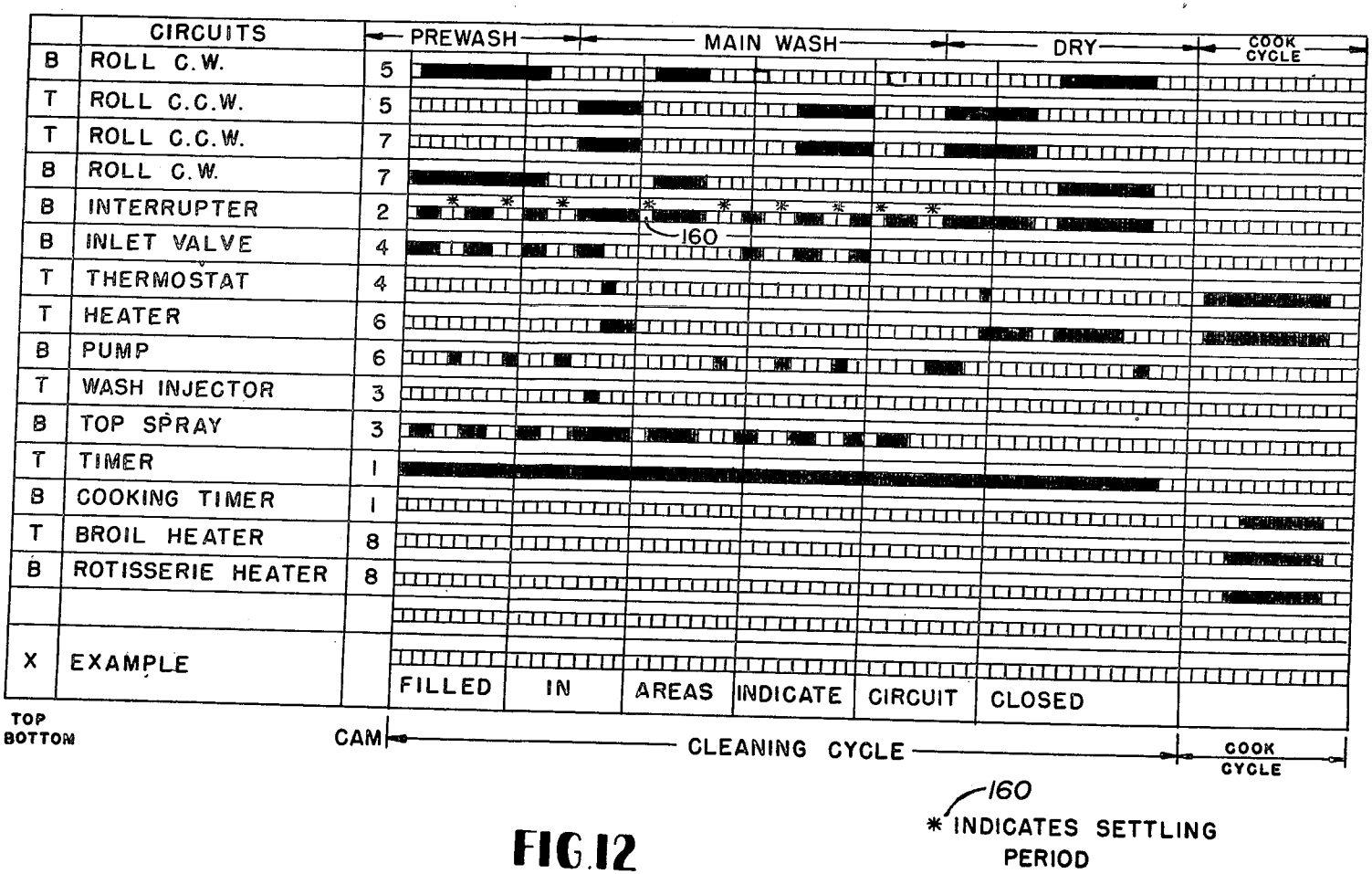
FIG. 12 is a chart illustrating a programmed timing cycle which includes the cleaning cycle and cooking cycle, also a settling or abeyance period at 160.

In operation the timing means is programmed to provide a settling period as shown in FIG. 12 at 160. This abeyance period permits air, foam, suds and washing fluid to settle out of the impeller means, the pump and sump.

When the impeller means starts to operate the fluid has been conditioned by getting rid of the air and suds, to cause the impeller to impel its maximum amount of fluid and having its greatest pressure, which at this period removes the largest amount of food-soil from the oven walls and tableware. This condition decreases as air, foam and suds increase. The fluid impelled by the impeller cascades the fluid over the tableware, removing the soil.

The fluid, ladened with food, runs down the raceway into the sump area.

When it reaches the area 140, the portion of the fluid heavily laden with food continues under the baffle and is recirculated. The fluid under the baffle, laden with food, continues to the whirlpool area where it remains until discharged.

On completion of the cleaning cycle, the timer stops the impeller, and after the oven is drained the pump 135 is shut off.

The operation is repeaated without detergent for the desired number of rinses.

FIG. 7 shows connection socket 140' which has a waterproof cap 141 (FIG. 8) which is removed exposing female sockets for plugging in broiling heating element 142 which is attached to frame 143.

Figure 8:
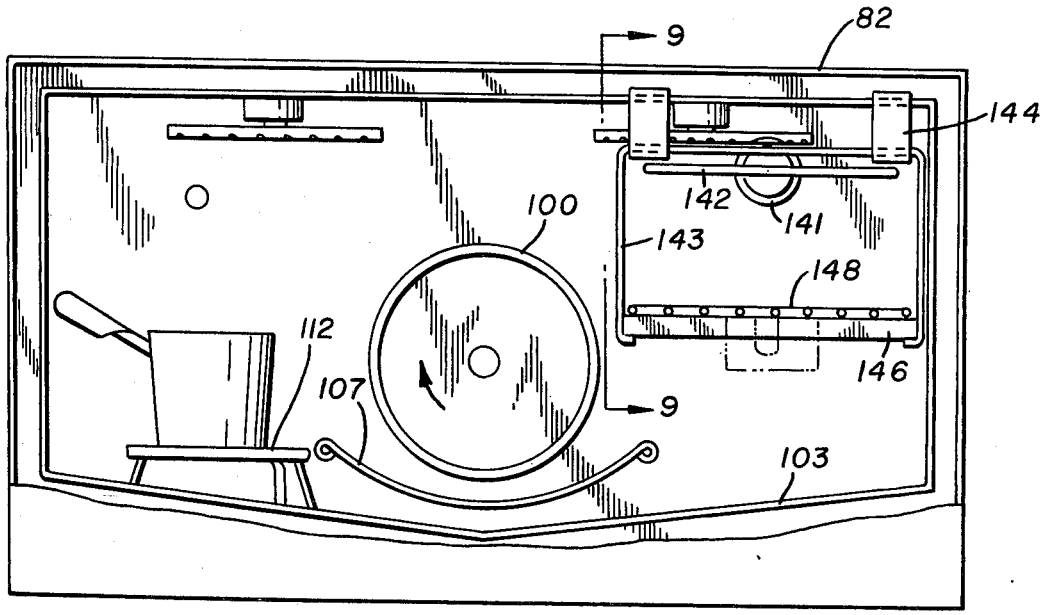
FIG. 8 is a front view of the enclosure shown in FIG. 7; with the door removed and broiler tray in place.

The male plugs of heating element 142, FIG. 8, plug into female socket 140' supporting the back of unit 143.

Angle frame 144 lips into 82 to support the front portion of unit 143.

Broiler tray 148 is supported in unit 143 by protruding tray supports 146.

Socket 140' is connected by wiring to selector switch 149 (FIG. 3).

Unit 143 is readily removed when not in use.

FIG. 8 shows heating element 112 being used as a surface unit for frying, boiling etc.

This heating element is wired to timer switch 121 and to switch 156 (FIG. 3).

Thermo-control unit 157 is wired to switch 156 and time 121 (FIG. 3). The unit 157 is calibrated for normal cooking operations in the range up to 550° F.

Figure 9:
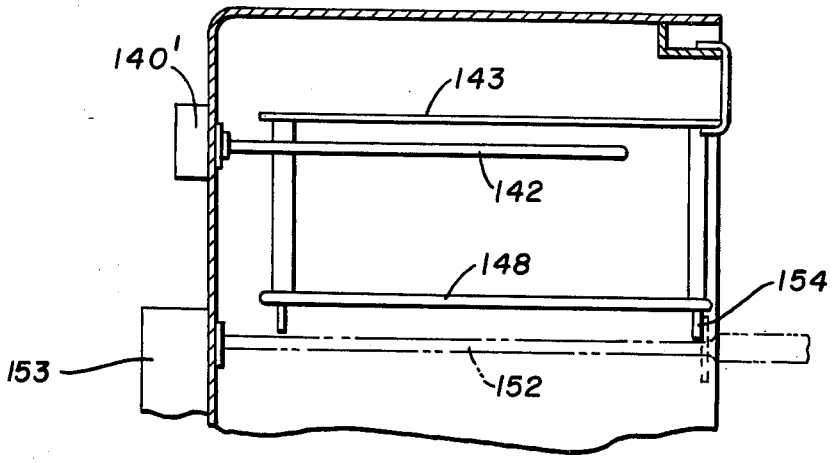
FIG. 9 is a side section with a rotisserie in place, as shown by lines 9—9 of FIG. 8.

FIG. 9 shows rotisserie unit 152 supported in rotisserie motor drive unit 153 and on support 154. Rotisserie is wired to selector switch 149 (FIG. 3).

Four-hour timer switch 158 is wired to the ground line of all heating elements and to ground line of timer switch 121.

FIG. 12 shows timer cycle chart which will now be described in the operation of the apparatus.

Filled-in areas indicate circuit closed, while open areas indicate an open circuit.

The interrupter line 160 indicates a programmed open circuit to cause a delay in the operation of the impeller.

Said delay permits the settling out of air, foam or suds and food-laden fluid from the impeller, sump and pump for operation efficiency as herein explained.

DISHWASHER CLEANING CYCLE

A chemical having a ph of about 12 is applied over residue cooking grease contained on the inner surfaces of the oven to convert the grease to a water soluble solution, then detergent is placed in the detergent reservoir 116 also in the sump area of the oven.

The door is closed. Timer 121 is activated.

Time-controlled inlet water fill valve 92 admits liquid to the desired fill in the washing chamber.

Pump 89 is started and top sprays 87 operate.

Motor in housing 101 is started and impeller 100 operates counter clock-wise for prewash period.

Pump 89 and motor 101 stops and inactivates fluid impelling means.

Discharge pump 135 activates to dispose of prewash fluid then is stopped.

The rinse period is repeated two or more times.

Inlet valve 92 admits water to wash chamber.

Pump 89 and motor in housing 101 is started and impeller 100 operated clockwise for main wash period impeller wash fluid sprays 87 also operate to impel fluid.

Detergent solenoid 120 is activated and releases pressure on tube 118 allowing fluid to flow in said tube and washes detergent out of container 116 by a flushing action and pushes the detergent into the cleaning chamber.

Motor in housing 101 and pump 89 is stopped which inactivates the fluid impelling means.

Timer 121 allows a settling pause period and causes air, foam, suds, and heavy matter to settle downwards in the fluid impelling means, sump and all surfaces within the oven area.

Pump 89 and motor in housing 101 is activated to reactivate the impelling means 100, operates in a counter-clockwise direction.

Pump 89 is started to impel fluid from sprays 87 in the chamber.

Pump 89 and motor in housing 101 is inactivated at end of this wash period. Discharge pump 135 is activated to dispose of fluid in the wash chamber and is stopped when said fluid is disposed of.

The main wash cycle without detergent injections is repeated two or more times as desired to rinse the dishware, after which the drain pump removes fluid from the wash chamber before the subsequent dry period.

Heater 112 is activated by timer 121.

Motor in housing 101 is started and impeller 100 is started to impel heated air in the chamber over dishware to dry them. Part way through the dry period the impeller 100 is reversed by timer 121 to impel air in the opposite direction over dishware.

Timer 121 at the end of the complete cycle turns off all operating parts.

STEAM COOKING ATMOSPHERE CYCLE

Food as desired is located in the oven and oven door is closed.

Oven thermostat control is set at about 200° F.

Timer 121 is set at a steam cooking position, which activates steam cooking cycle. Liquid is admitted to the oven and heater 112 is activated to generate steam in the oven atmosphere.

Oven thermostat controls the oven temperature at about 200° F.

Food can be removed when cooked or if desired held in the oven's steam atmosphere for later serving piping hot.

When food is removed from the oven the time is set at a liquid disposal position and when the liquid is removed from the oven the timer inactivates said cycle.

LIQUID IMPELLED COOKING AND SURFACE CLEANING CYCLE

Food package in water tight containers as desired is located in the oven. Oven door is closed.

Oven thermostat is set at 200° F.

Timer 121 is set at a liquid cook position to activate cycle.

Liquid is supplied to oven and impeller impels liquid over food containers.

Food can be removed from the oven when done or if desired held in the oven's liquid impelled asmosphere for later serving piping hot.

When the food is removed from the oven the time is set at a liquid disposal position and when the liquid is removed from the oven the timer inactivates said cycle.

DRY HEAT OVEN COOKING ATMOSPHERE

Food is located as desired in the oven. Oven door is closed.

Oven thermostat is set at a desired temperature in order to activate cycle.

Timer 158 is set at a desired cooking period. When food is ready said food can be removed when desired from oven. During the cooking period, impeller 100 is activated to circulate heated air taken from heater 112.

This heated air circulates over the foods heating said food in order to cook said food.

Chilled air is circulated back to the heater and is recirculated.

Timer inactivates cooking cycle at end of cooking period.

LIQUID SPRAYING TO DEFROST PACKAGED FOODS IN PLASTIC

Packaged food in water-tight containers is placed on combination tray 75. Door is closed. Hot water without detergent is sprayed through 87 and by impeller 100.

The heated water sprayed over the containers transfers heat to the food and the timed cycle heats the food to serving temperature.

ROTISSERIE

Food as desired is located in oven.

Timer 121 is set at desired time.

Switch button 149 is depressed for rotisserie operation.

When desired cooking time has elapsed, timer 121 stops all operations.

Residue which has dropped to sump area is washed out of unit when the device is put through a wash cycle.

BROILING

Broiler unit 143 is attached to unit.

Meat is placed on rack 148.

Switch 149 is pressed to broil position.

Timer is set at desired time.

Meat is manually turned and cooking is continued until meat is ready to serve.

Grease and cooking residue drops to bottom of unit and is cleaned out when unit is put through a washing cycle.

This method of not requiring a residue pan with either a rotisserie or other broiling, to catch grease, etc., allows the excess fats to be broiled out of foods and provides an easy way to dispose of these fats by neutralizing them with a high caustic detergent in the ph range of 12 and diluting them and disposing of the residue down the drain. Water may be placed in the bottom of the oven during such cooking to collect the drippings.

It is a well known fact that broiled foods are more healthy to eat.

Cooks in households know that grease odors quickly develop into objectionable odors in a hurry and housewives are reluctant to mess up their present oven because of the involved cleaning of them.

My new method is an improvement even over the heat self-cleaning ovens newly on the market.

BAKING

Timer 121 is set for cooking time desired.

Foods to be baked are placed on combination tray 75.

Thermostat 157 is set at desired temperature.

Door is closed.

Unit is started by pressing bake switch 156.

When time has elapsed, food is ready.

The impeller is used to circulate heated air through the oven and eliminates hot spots and contributes to maintain a close tolerance of temperature.

Improved baking results because of this even temperature.

Fumes and odors are circulated over and around the heater 112 and are degraded by the high heat of the element.

The chamber can be used as a warming oven by simply setting the thermostat at warming position.

FIG. 12 is a chart giving suggested timing cycles.

Such cycles includes one or more of the following operations named at the top of the several columns of the chart; Pre-wash, Main Wash, Dry and Cook.

The cycle which include cooking with any one or more of the other operations are new.

The possible specific operations are listed one below the other at the left of the chart.

Thus, "Roll C.W." stands for clock-wise rotation of the impeller 100.

Roll C.C.W. stands for counter-clock-wise rotation.

"Wash Injector" stands for detergent dispensing means.

A usual timer includes a number of cams, the bottom and top of each of which is designed for actuating different operations, and in the chart "T" and "B" refer to the tops and bottoms of the different cams, and the cams are identified by their numbers in the third column of the table.

The portion of the chart which refers to the different operations is divided into time increments, the length of each increment depending upon the number of degrees for each impulse.

The filed areas indicates, as illustrative, the number of time increments during which the apparatus for the different operations is activated.

The timer selected dial (not shown) is of any usual construction.

What I claim is:

1. A self-cleaning oven comprising:

a fluid impeller consisting of a reversible motor driven substantially smooth roller rotatable mounted within an oven chamber adjacent its bottom and extending a substantial distance across the oven, a drain in the bottom wall of the oven, under the axis of the impeller with the bottom of the oven adapted to drain thereto, an imperforated baffle under the impeller with the opposite edges turned up to a level above the bottom of the impeller, a first space between the impeller and the baffle and a second space between the baffle and the bottom of the oven, said oven being adapted to be filled with a fluid to a level just above the bottom of the impeller, and means within said oven to supply heat to said oven and the fluid therein, whereby upon rotation of said impeller means in one direction the fluid is impelled up out of the first space in the upwards revolving direction of said impeller and impelled downwards as the impeller returns toward the first space, thereby and upon reversal of the direction of rotation impelling fluid throughout said oven to dislodge soil particles from all surfaces within said oven, said soil particles being concentrated in said second space at the side of the bottom wall drain in said one direction due to the greater amount of fluid flowing towards said bottom wall drain from said one direction as compared to the amount flowing towards said bottom wall drain from the opposite direction.

2. A keep clean heated water-impelled and circulated cooking oven, wherein surfaces are cleaned during cooking operation by circulating a heated water over surfaces within said oven comprising:

*a*, oven chamber means having a combination rack therein to support food or articles to be cleaned or cooked,

*b*, means to vent air from the interior of said oven while water is circulated within said oven,

*c*, means to supply a desired amount of water to said oven,

*d*, means to supply heat to the oven and said water,

*e*, means to preset a desired temperature and maintain a desired temperature of said water during cooking and cleaning operations,

*f*, means to impel and circulate water within said oven,

*g*, means to drain water from said oven,

*h*, cycle timer means connected to means *c*, *d*, *e*, *f*, and *g* whereby said timer operates *c*, to supply a desired amount of water to said oven, operates means *d*, or *e*, to heat said supplied water and maintain a desired temperature of water being impelled and circulated by means *f*, during a desired period of operation of said means *f*, operates means *g*, to drain said water from said oven upon completion of said desired period of operation of said water impelling means, whereby during said operations surfaces within said oven are cleaned by the same means that cooks food within said oven.

3. The combination as claimed in claim 2, having additional cycle timer programming means *h* comprising: means to de-energize means *f*, after means *f*, has operated to impel or circulate water within said oven, means to operate means *g* to retain the prior impelled or circulated water within said oven for a desired period of time, means to energize means *f*, after a desired period of time to recirculate or reimpel the retained water within said oven for a desired period of time.

4. The combination as claimed in claim 2.

having additional timer means comprising:

means to selectively move means *h*, when desired to a portion of the operating cycle wherein only means *e*, *d*, and *h*, are controllable by the cycle timer means.

5. A liquid type apparatus for spray heating a mass or cleaning a surface within a chamber by spraying a heated fluid onto said mass or onto said surface within said chamber comprising:

spray means to direct and cause a heated fluid to be sprayed onto said mass or surface within said chamber; and timing control means connected to said spray means to activate and inactivate said spray means to provide a period of operation of said spray means to spray said heated fluid onto said mass or surface within said chamber and an abeyance period to allow said sprayed fluid to actively settle downward on said mass or surface within said chamber, including first timing control means to activate said spray means to spray said heated fluid onto said mass or surface, second timing control means to inactivate said spray means to enable said heated fluid sprayed onto said mass or surface to actively settle downward on said mass or surface within said chamber during said timed period whereby said mass is heated or cooked or surface is cleaned during said time periods.

6. In an automatic dishwashing apparatus or an oven apparatus of the liquid impelled and recirculating liquid type comprising:

a tank defining a water-tight chamber having a sump bottom area, rack means within said chamber for supporting articles having food mass thereon, means for supplying water into said chamber for combining with a water soluble cleaning compound in said chamber to form a cleaning solution within said chamber, means for recirculating said cleaning solution to effect spraying of said cleaning solution onto surfaces or onto articles having a food mass thereon within said chamber, means for draining said cleaning solution from said chamber, a program timer system having means for controlling said water supplying means to induce a predetermined volume of water within said chamber, means for controlling said recirculating means to impel said cleaning solution onto said surfaces or said articles having a food mass thereon within said chamber, means for controlling said draining means to drain said cleaning solution from said chamber, means for retaining said cleaning solution in said chamber, the improvement wherein said timer control system comprises: means for de-energizing said recirculating means after said articles or said surfaces within said chamber receive the impelled cleaning solution, means for retaining said cleaning solution within said chamber, and also maintaining said recirculating means de-energized for a continuous desired period of time to permit the cleaning solution not retained by said surfaces or said articles having a food mass thereon within said chamber to be conditioned by allowing said cleaning solution to settle downward toward the sump area of the bottom of said chamber, and also to permit air, foam, suds or said cleaning solution to settle out of said recirculating means and to permit air, foam, suds or said cleaning solution to settle down in the sump bottom area of said chamber, means to re-energize said recirculating means for a desired period of time to recirculate the retained conditioned cleaning solution onto said surfaces or onto said articles having a food mass thereon within said chamber to permit improved removal of food soil from said articles or cleaning said surfaces within said chamber, means for actuating said drain controlling means for draining said cleaning solution from said chamber when desired.

* * * * *